US005295496A

United States Patent [19]

Machelett

[11] Patent Number: 5,295,496

[45] Date of Patent: Mar. 22, 1994

[54] COMPACT FOR COSMETIC PREPARATIONS

[75] Inventor: Dietrich Machelett, Meinerzhagen, Fed. Rep. of Germany

[73] Assignee: Wilhelm Koopman KG, Meinerzhagen, Fed. Rep. of Germany

[21] Appl. No.: 955,847

[22] Filed: Oct. 2, 1992

[30] Foreign Application Priority Data

Sep. 24, 1992 [EP] European Pat. Off. ..... 92116310.1

[51] Int. Cl.[5] ..... A45D 42/02

[52] U.S. Cl. ..... 132/293; 132/301; 220/263

[58] Field of Search ..... 132/293, 294, 300, 301; 220/263, 264; 206/823

[56] References Cited

U.S. PATENT DOCUMENTS

| | | | |
|---|---|---|---|
| 4,930,528 | 6/1990 | Hatakeyama | 132/293 |
| 4,951,692 | 8/1990 | Yuhara et al. | 132/293 |
| 4,989,622 | 2/1991 | Kozuka et al. | 132/293 |
| 5,050,623 | 9/1991 | Yuhara et al. | 132/293 |

*Primary Examiner*—John G. Weiss

*Attorney, Agent, or Firm*—Edwin D. Schindler

[57] ABSTRACT

A compact for cosmetic preparations having a housing part, a powder tray and/or insert containing the like inside the housing part and a lid coupled by way of a hinge, having a first catch integrally formed on the lid and cooperating with a second catch, as well as having a presser for releasing the catches. The problem is reliable opening of the compact and high strength of the catches, also inexpensive manufacture of the compact and ease of operation for the user. The second catch is seated in the region of the housing part. The presser is displaceable in the housing part, releases the catches by pressing thereon and opens the lid.

6 Claims, 6 Drawing Sheets

COMPACT FOR COSMETIC PREPARATIONS

BACKGROUND OF THE INVENTION

1. Field of the invention

The invention relates to a compact for cosmetic preparations having a housing part, a powder tray and/or insert containing the like inside the housing part and a lid coupled by way of a hinge, having a first catch integrally formed on the lid and cooperating with a second catch, as well as having a presser for releasing the catches.

2. Description of the prior art

Reliable releasing of the catches requires an adequate travel for said catches and for the presser so that, even taking tolerances into account, the compact may be opened effortlessly. The parts have to be sufficiently robust and be guided in a smooth and ergonomically advantageous manner.

SUMMARY OF THE INVENTION

The aim of the invention is reliable opening of the compact and high strength of the catches, also inexpensive manufacture of the compact and ease of operation for the user.

Said aim is achieved according to the invention in that the second catch is seated in the region of the housing part, that the presser is displaceable in the housing part and, by pressing on the catches, releases the catches and opens the lid.

The invention differs from prior art in that the catch actuable by the presser is, for unlocking, deformable over its entire length. The path of deformation is therefore very great. The presser, on the other hand, may be rectilinearly adjusted over a long distance. The presser acts upon a long lever arm of the catch so that the required actuating force is low. From an ergonomic point of view, the precise guidance of the presser is advantageous for the user; for any horizontal swinging of the presser is felt to be unpleasant. The movements of the catches mean only slight degrees of deformation and during actuation are not perceived as unpleasant by the user. The release movements of the catches may be very slight, depending on the design of the detent lugs.

A reliably closing catch is achieved in that the second catch takes the form of a tongue, which is seated on the housing part.

A simple design for the catch is achieved in that the second catch takes the form of a projection of an insert of the housing part, into which the first catch engages.

Ease of movement and restoring of the presser is achieved in that elastically deformable carriers of the insert hold the presser in a flexible manner.

The smooth running of the presser may be influenced by providing a plurality of carriers for the presser.

The closing force of the catches may be utilized in that lugs of the catches with shaped surfaces engage one in the other.

Damage to the detent elements during the closure process is excluded in that the catches have shaped surfaces, which are inclined in closing direction and ensure that the catches slide one over the other during the closing process.

Raising of the lid upon opening is ensured in that a shaped surface of the presser cooperates during the opening process with the shaped surface of the first catch in the sense of raising the lid.

Short presser paths are achieved in that the shaped surfaces of the catches are aligned parallel to the direction of movement of the presser.

The rigidity of the detent elements may be influenced in that the second catch comprises a plurality of legs with shaped heads.

It is possible additionally to influence the rigidity in that the legs at their head end are connected by a web to a strip-shaped lug to form a gate-like arrangement.

A further adaptation to the desired conditions is possible in that the presser may be brought into engagement with the second catch.

In another manner it is provided that the presser may be brought into engagement with the first catch.

The opening force may be increased by providing, in the housing part, a ramp for raising the actuating projection of the presser.

Precise control of the unlocking process is achieved in that the actuating projection of the presser takes the form of a disengaging tongue, which is guided on the ramp.

Control is possible in such a way that a guide surface of the presser cooperates with the ramp.

Direct guidance of the presser in the housing part is enabled by the fact that the presser is guided along guide webs of the housing part.

Thus, resetting of the presser is also achieved in such a way that detent tongues of the presser engage in profiles and detent lugs of the guide webs.

BRIEF DESCRIPTION OF THE DRAWINGS

Embodiments of the invention are described below with reference to the drawings, which show.

DESCRIPTION OF PREFERRED EMBODIMENTS

Figure 1:
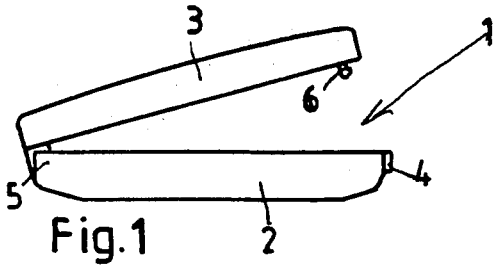
FIG. 1 a view of a partially open compact.
Figure 2:
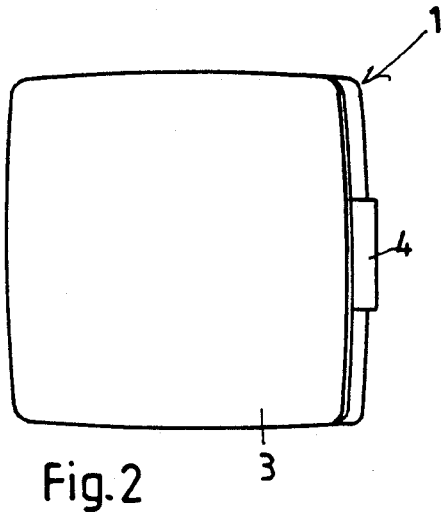
FIG. 2 a plan view of FIG. 1.

FIGS. 1 and 2 are diagrammatic views of a compact 1 for cosmetic preparations, comprising a housing part 2 with a presser 4 and a lid 3. The lid 3 is connected by a hinge 5 to the housing part 2. A first catch 6 is integrally formed in one piece in the lid 3. The second catch 7 is integrally formed in one piece on the base 8 of the housing part 2, as is evident from FIG. 3. The presser 4 is displaceable inside the front wall 10 of the housing part 2 and thereby enables unlocking of the catches and opening of the lid 3. The housing part 2 is of a shell-shaped construction and accommodates an insert 9 for a powder tray or the like. The housing part 2, the lid 3 and the insert 4 are thermoplastic injection-moulded parts made of the same or differing thermoplastic materials.

Situated on the insert 9, e.g. on one of its side walls, are one or more carriers 11, which support the presser 4. The carriers 11 are strip-like, i.e. as thin and deformable as possible, so that the presser 4 may be moved with a low expenditure of force. The insert 9, the carriers 11 and the presser 4 are constructed in one piece.

Figure 3:
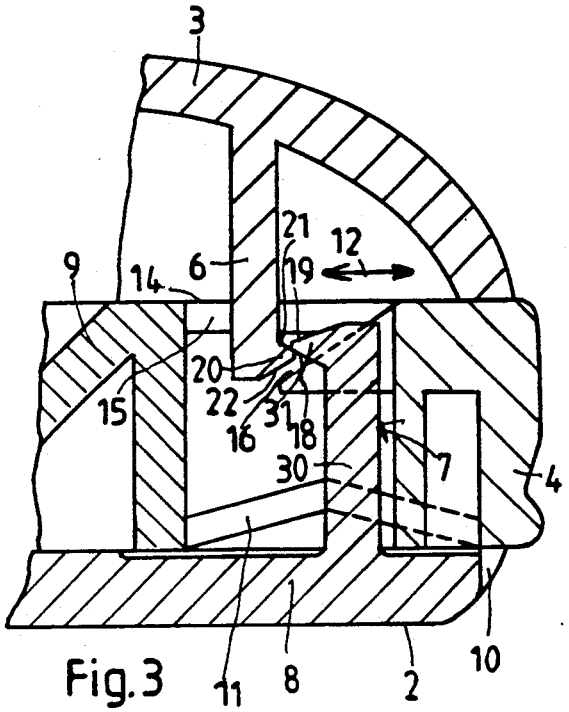
FIG. 3 a part-sectional view with details of the catches in the closed state, FIG. 4 a plan view of FIG. 3, FIG. 5 a modified form of the catches, FIG. 6 a further modification of the catches, FIGS. 7 to 9 individual examples of catches, FIG. 10 a further construction of the catches FIGS. 11 to 13 various embodiments of catches with a high opening force, FIGS. 14 to 16 a modified guide of the presser, FIG. 17 a modification of the catches, and FIG. 18 a front view of the catches.
Figure 4:
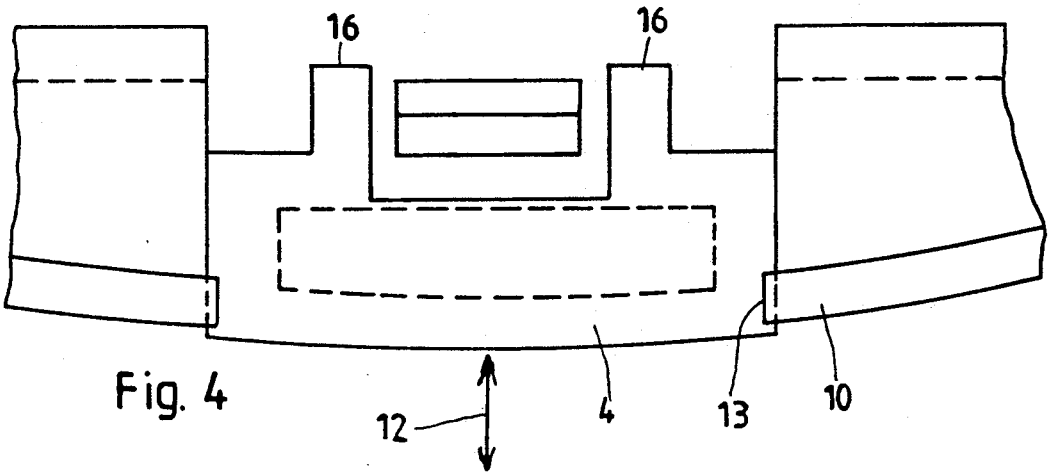

The presser 4 projects through an opening 13 in the front wall 10 of the housing part 2 and is movable in the directions of the double arrow 12, FIGS. 3 and 4. The carriers 11 effect resilient support and restoring. The insert 9 has a plate-like projection 14 with an opening 15, through which the first catch 6 projects. Provided on the inside of the presser 4 are one or more shaped surfaces 16, which are inclined relative to the direction of movement and, on movement of the presser, engage with the first catch 6.

The second catch 7 substantially comprises a plate-like leg 30 and has, at its top end, a lug 18 with a shaped surface 19. The detent surface 31 of the lug 18 is also inclined relative to the direction of movement of the presser 4.

The first catch 6 on the lid 3 has a lug 20, which is shaped so as to be substantially complementary to the lug 18. A shaped surface 21 in inclined in accordance with the shaped surface 31. A shaped surface 22 is also provided, which is constructed so as to match the shaped surface 16. The catch 6 extends through the opening 15.

FIG. 3 shows the catches in the locked state. The first catch 6 engages with the shaped surface 21 behind the shaped surface 31 of the second catch 7. The compact 1 is thereby held closed.

For opening, the presser 4 is pressed inwards. The lug 20 is disengaged from the lug 18 so that the lid 3 may be raised. An additional aid may be provided for partial raising of the lid.

To ensure that the catches 6 and 7 attain the locked position when the compact is closed, the shaped surfaces 19 and 21 are provided, which cause the catches to yield upon closure of the compact.

Figure 5:
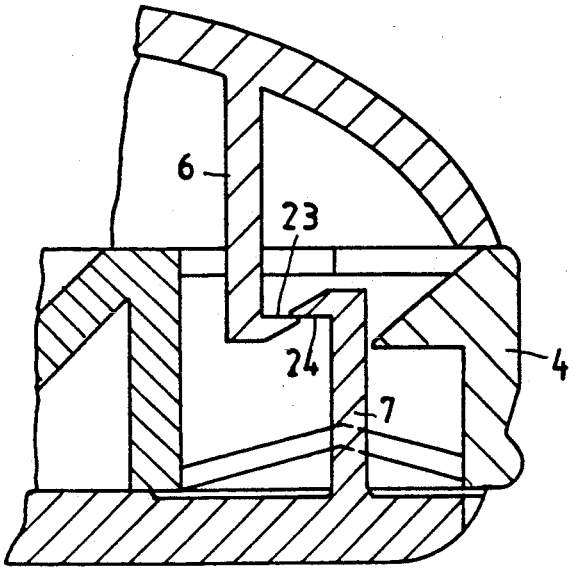

The embodiment of FIG. 5 shows catches 6 and 7, whose detent surfaces 23 and 24 are aligned parallel to the direction of movement of the presser 4. Even without shaped surfaces and a wedging action, reliable locking is possible. The engagement of the catches may be comparatively slight.

Figure 6:
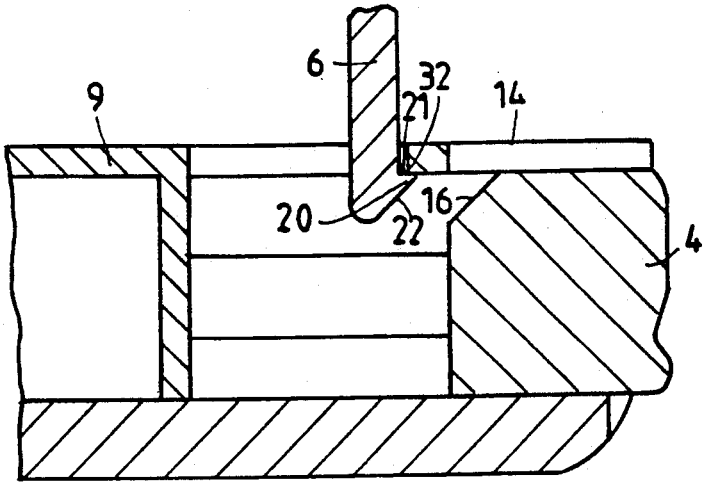

The embodiment of FIG. 6 utilizes, as a second catch, a lug 32 or edge of the projection 14. The lug 20 of the first catch 6 has a detent surface 21 aligned parallel to the surface of the projection 14. The shaped surface 16 of the presser 4 cooperates with the shaped surface 22. On actuation of the presser 4, the lug 20 of the first catch 6 is pressed over the lug 32 of the second catch or of the projection 14, so that the lid 3 may be opened.

Figure 7:
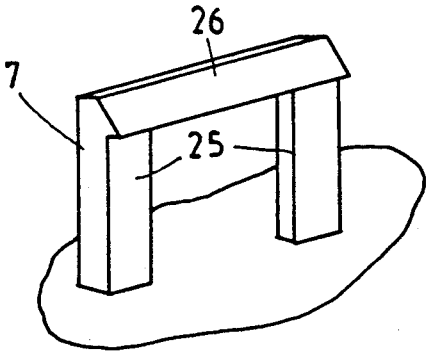
Figure 8:
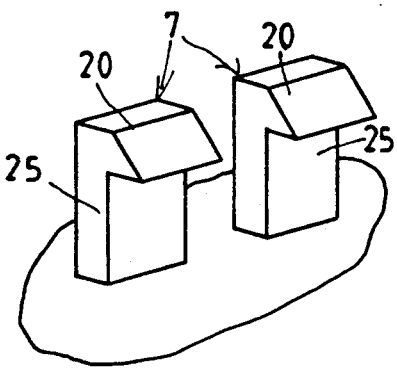
Figure 9:
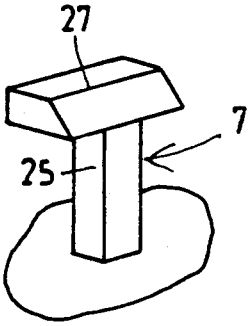

FIGS. 7 to 9 illustrate various embodiments of the catches using as an example a second catch 7. According to FIG. 7, the catch 7 comprises two legs 25, which are connected to one another by a web 26 and so form a gate-like arrangement. FIG. 8 shows a catch 7 comprising two separate legs 25 each with a lug 20. FIG. 9 shows a catch 7 with a web 25 and a web-like head 27 protruding on either side to produce a hammer-like arrangement. Modifications or combinations of said forms are also possible.

Figure 10:
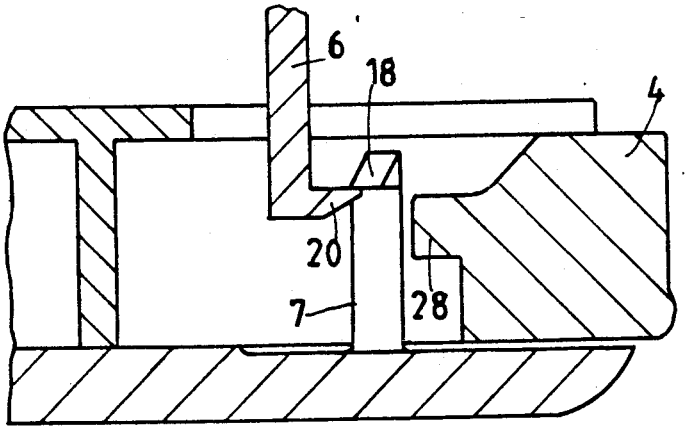

FIG. 10 illustrates the use of a gate-like catch 7, whose lug 18 cooperates with the lug 20 of a first catch 6. A shaped projection 28 of the presser 4 engages through the gate-like opening of the second catch 7.

Figure 11:
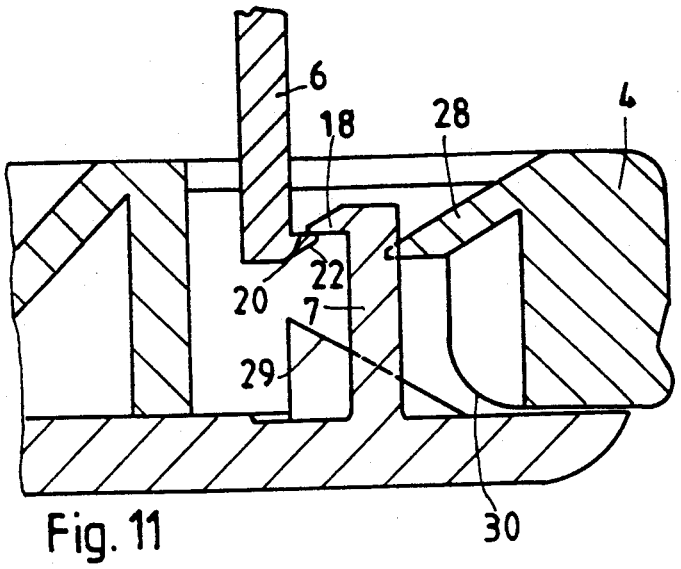

The embodiment of FIG. 11 operates with an increased opening force. The shaped projection 28 of the presser acts upon the shaped surface 22 of the catch 6. A ramp 29 disposed in the housing part 2 forms a run-on surface for a guide surface 30 of the presser 4. During the opening movement, the shaped projection 28 of the presser 4 is pressed upwards. The opening force is thereby increased.

Figure 12:
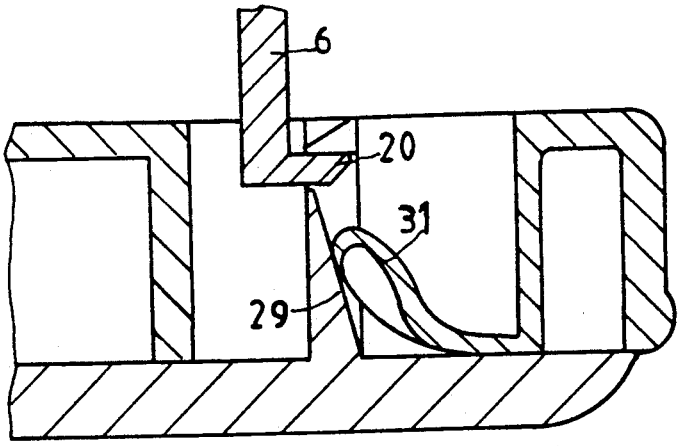

In the embodiment of FIG. 12, an elastically resilient disengaging tongue 31 is provided on the presser 4 and is guided upwards on a ramp 29 of the housing part 2. The disengaging tongue 31 engages with, and exerts an opening Pressure upon the lug 20 of the catch 6.

Figure 13:
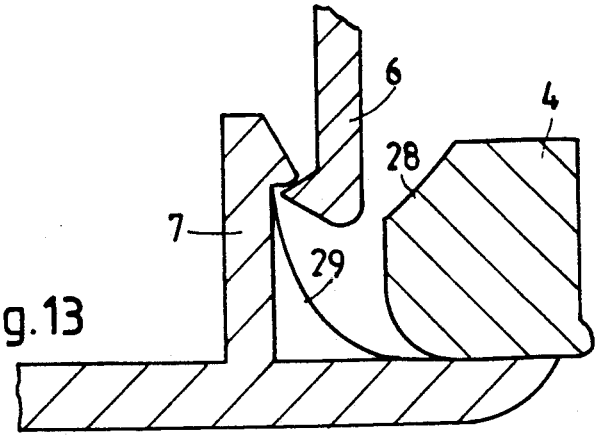

FIG. 13 shows an embodiment, in which the catch 6 is disengaged in an upward direction.

Figure 14:
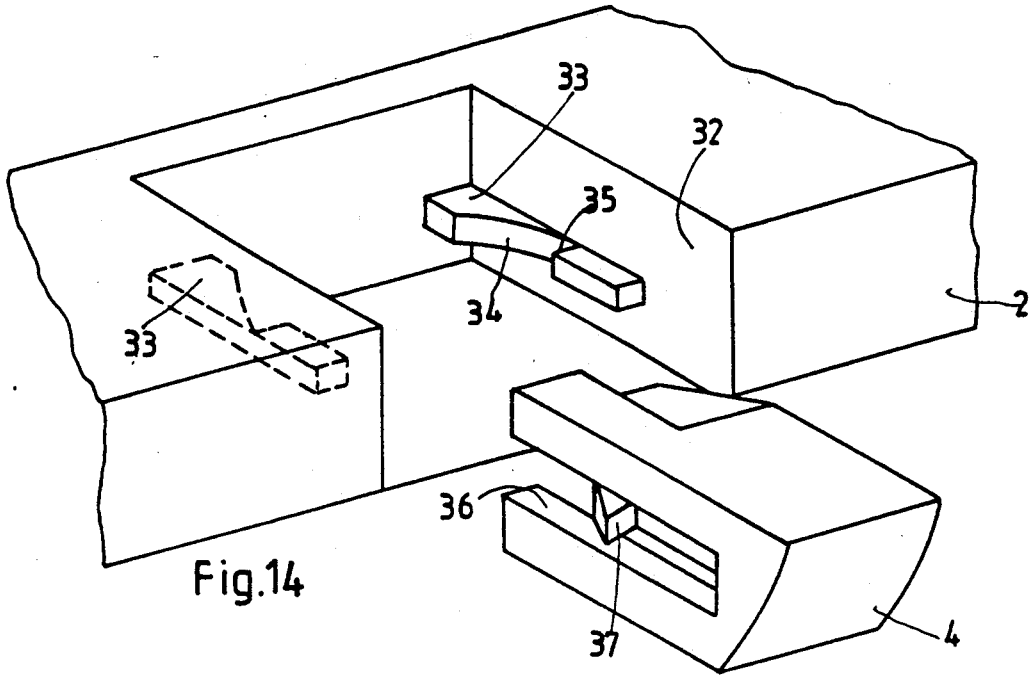
Figure 15:
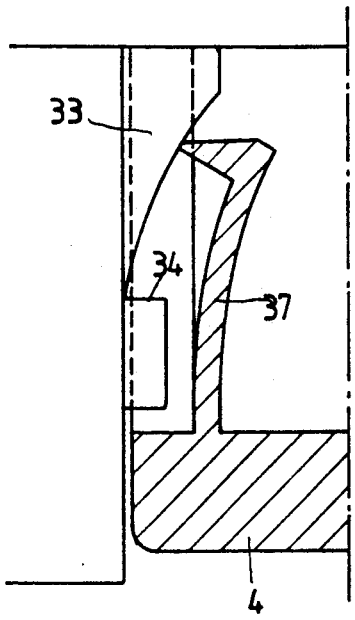
Figure 16:
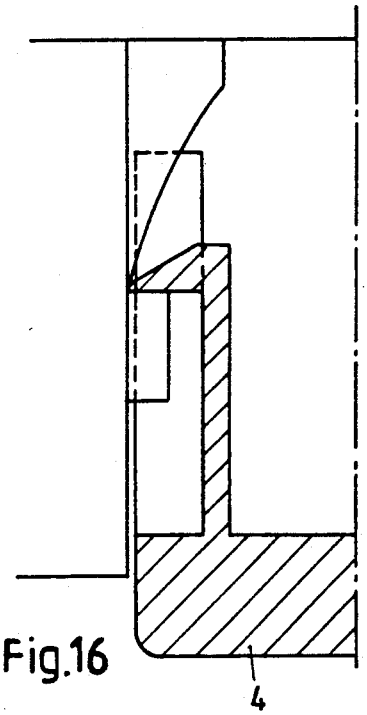

FIGS. 14 to 16 shows a modified guide of the presser 4. In a pocket or other cut-out portion of the housing part 2, guide webs 33 with a profile 34 and a detent lug 35 are formed in side walls 32. In the side walls of the presser 4 are recesses 36, into which guide webs 33 engage. Detent tongues 37 engage behind the detent lugs 35 and lock the presser 4 in the normal position. During the opening movement of the presser 4, the detent tongues 37 slide along the profiles 34. The resultant deformation of the detent tongues 37 generates a restoring force for resetting the presser into the normal position.

Figure 17:
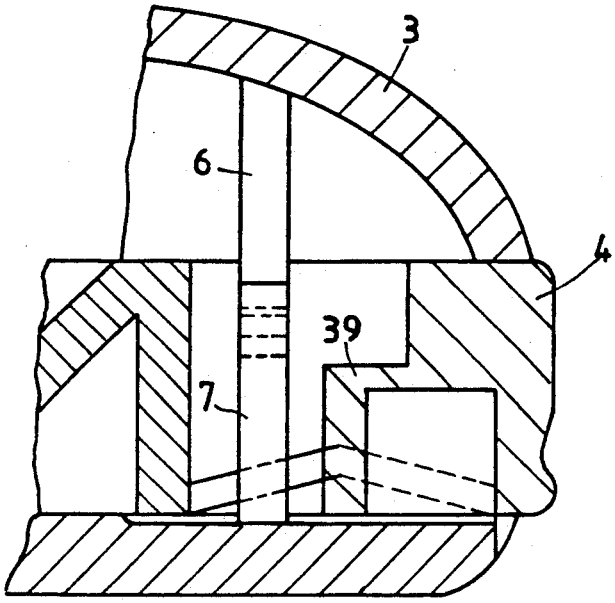
Figure 18:
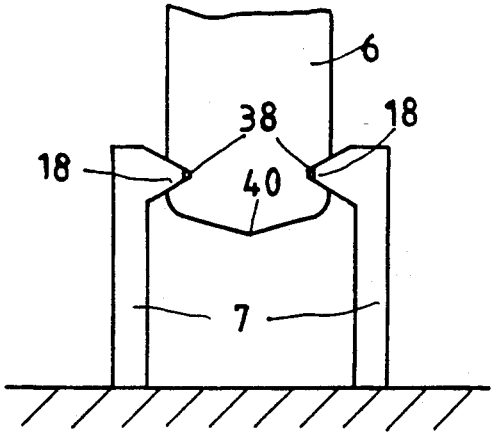

The embodiments hitherto described have the detent edges aligned parallel to the axis of the hinge 5. According to FIGS. 17 and 18, the detent edges of the catches 6 and 7 may alternatively be aligned at right angles to said axis. In the illustrated embodiment, the catch 6 has two grooves 38, which are aligned at right angles to the axis of the hinge 5. Two catches 7 engage, in each case, with a lug 18 into a groove 38. A shaped projection 39 of the presser 4 comes during the opening movement into engagement with the front part 40 of the catch 6 and/or with the catches 7. The catches are thereby released, so that the lid may be opened. The profiles may be constructed in a different manner.

I claim the following:

1. A compact for cosmetic preparations, comprising:
a housing part;
a powder tray being contained within said housing part;
a lid for said housing part being coupled to said housing part by hinge means;
a first catch and a second catch, said first catch being integrally formed on said lid and cooperating with said second catch, said second catch being seated in the region of said housing part;
a presser movable in said housing part for releasing said first and second catches from one another;
an insert containing said power tray which is contained within said housing part; and,
an elastically deformable carrier for said insert for holding said presser in a flexible manner.

2. The compact for cosmetic preparations according to claim 1, wherein said second catch is constructed as a tongue with said second catch being seated on said housing part.

3. The compact for cosmetic preparations according to claim 1, wherein a plurality of said carriers are provided for said presser.

4. The compact for cosmetic preparations according to claim 3, further comprising lugs for said first catch and said second catch having shaped surfaces for engaging one of said lugs with the other of said lugs.

5. The compact for cosmetic preparations according to claim 4, wherein said first catch and said second catch have shaped surfaces which are inclined in a closing direction for ensuring that said first catch and said second catch slide one over the other during a closing process for said compact.

6. The compact for cosmetic preparations according to claim 4, wherein said presser has a shaped surface for cooperating, during an opening process for said compact, with the shaped surface of said first catch for raising said lid.

* * * * *